US005103526A

United States Patent [19]

Berfield

[11] Patent Number: 5,103,526

[45] Date of Patent: Apr. 14, 1992

[54] LIQUID DISPENSING AND SUCTIONING SYSTEM FOR SURFACE CLEANING

[75] Inventor: Robert C. Berfield, Jersey Shore, Pa.

[73] Assignee: Shop Vac Corporation, Williamsport, Pa.

[21] Appl. No.: 282,103

[22] Filed: Dec. 9, 1988

[51] Int. Cl.[5] ..... A47L 7/00

[52] U.S. Cl. ..... 15/322; 15/302

[58] Field of Search ..... 15/302, 310, 320, 222

[56] References Cited

U.S. PATENT DOCUMENTS

| | | | |
|---|---|---|---|
| Re. 25,939 | 12/1965 | Krammes | 15/320 |
| 1,454,381 | 5/1923 | Stepp | 15/320 |
| 1,554,875 | 9/1925 | Miles | 15/320 UX |
| 2,149,453 | 3/1939 | Longshore et al. | 15/320 |
| 2,568,803 | 9/1951 | Guenst | 15/321 |
| 2,822,061 | 2/1958 | Pettit et al. | 15/322 X |
| 2,986,764 | 6/1961 | Krammes | 15/320 |
| 4,218,900 | 8/1980 | Caplan et al. | 15/322 X |
| 4,320,555 | 3/1982 | Watson | 15/321 |
| 4,329,756 | 5/1982 | Chicoine et al. | 15/322 X |
| 4,333,203 | 6/1982 | Yonkers | 15/322 |
| 4,485,518 | 12/1984 | Kasper | 15/322 |
| 4,534,083 | 8/1985 | Hampson | 15/321 |
| 4,845,802 | 7/1989 | Miller et al. | 15/322 X |
| 4,910,828 | 3/1990 | Blase et al. | 15/321 |

*Primary Examiner*—Frankie L. Stinson

*Attorney, Agent, or Firm*—Ostrolenk, Faber, Gerb & Soffen

[57] ABSTRACT

Dispensing within a liquid dispensing and suctioning system is controlled by pinching a flexible tube with a spring-biased actuator. The system includes a slidable extension for pulling the actuator to open the tube to dispense liquid to a surface to be cleaned. The system is assembled with a tubular wand of a wet/dry suctioning system.

16 Claims, 5 Drawing Sheets

FIG. 1.
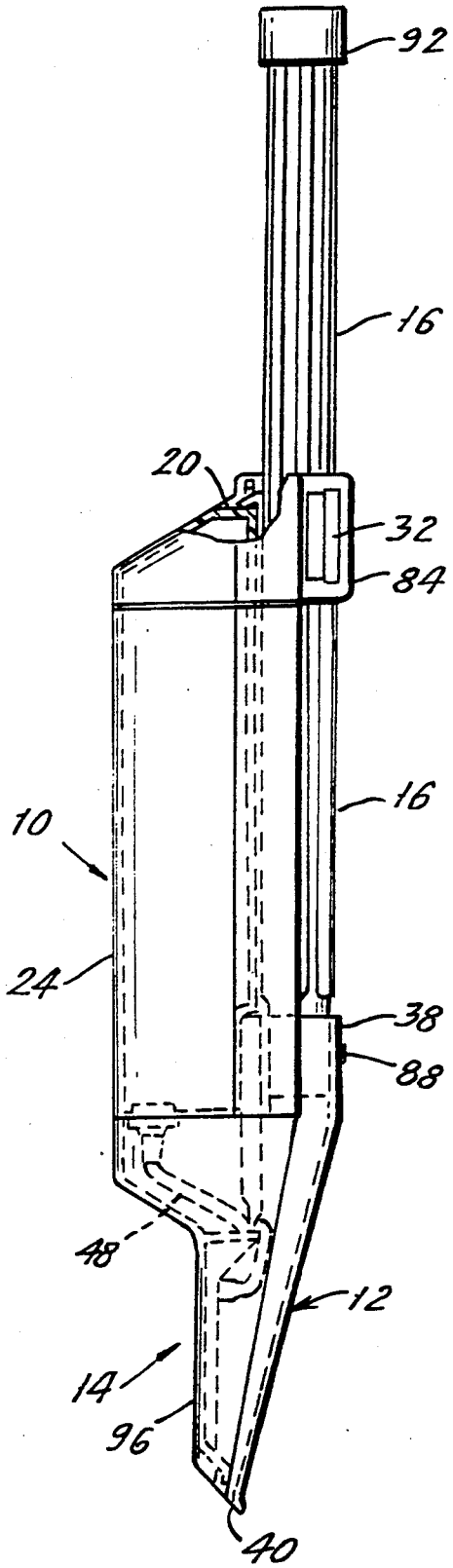
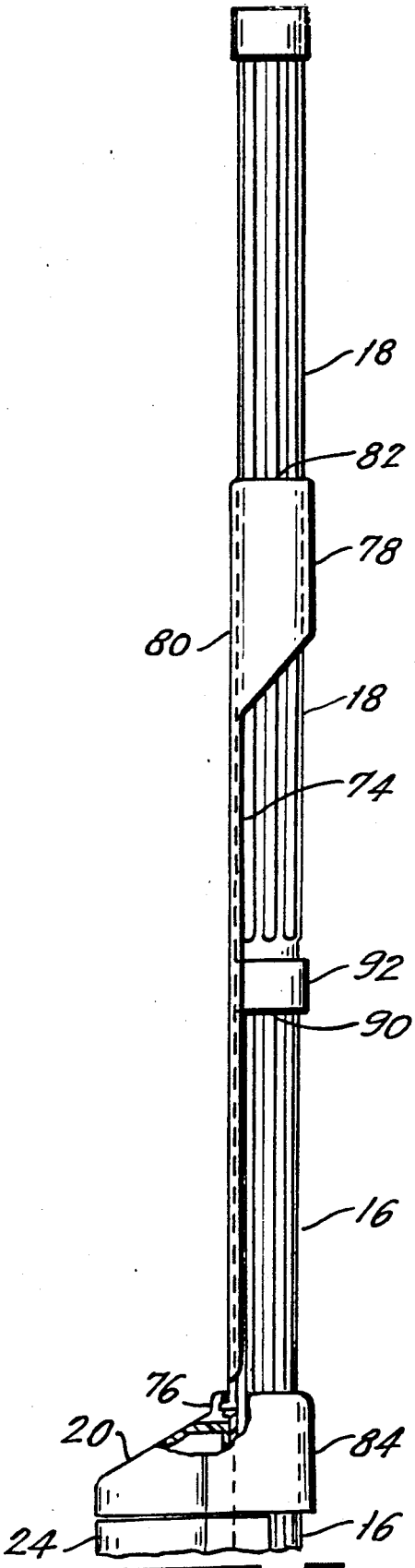
FIG. 2.

LIQUID DISPENSING AND SUCTIONING SYSTEM FOR SURFACE CLEANING

BACKGROUND OF THE INVENTION

The invention relates to a system for cleaning a surface. The system includes means for storing a cleaning liquid, means for dispensing the liquid to the surface to be cleaned and means for suctioning the liquid along with any dirt, and the like, that has been washed from the surface or dissolved in the liquid from the surface.

The prior art includes wet/dry suctioning systems which are adapted to pick up dispensed liquid and wet materials from a surface. Such suctioning systems typically include a collection tank, a take-up hose for transmitting the liquid or the wet materials from the surface to the collection tank and a suction motor, typically communicating with the tank, for generating a vacuum in the hose.

A surface can be cleaned more easily by spreading a cleaning liquid, such as a solution of water and detergent, across the surface. The surface can be a floor, a carpet or other surface. The liquid facilitates cleaning by dissolving and lifting off dirt, and the like, from the surface to be cleaned. Furthermore, the subsequent suctioning helps to dry the surface or carpet by lifting away the liquid and wet material from the surface.

Accordingly, liquid dispensing and suctioning systems have been developed to dispense cleaning liquid to a surface or carpet to be cleaned and to thereafter suction the liquid from the surface after the liquid has dissolved or lifted off dirt, and the like. Some of these liquid dispensing and suctioning systems are entirely self contained. Others are developed as attachments to an intake hose or wand of a standard wet/dry suctioning system. The liquid may be supplied to the attachment from an external source through a hose or tube or the liquid may be carried on the cleaning attachment within a tank.

In some systems, liquid may drip continuously through a nozzle leading from a liquid supply container. However, it is advantageous to selectively control the dispensing of liquid from the liquid dispensing and suctioning systems. Such control may be achieved, for example, by a manually operable trigger for opening a dispensing nozzle or valve. Liquid may be dispensed periodically or continuously. However, in general, these systems are complicated, expensive to fabricate and to transport and are difficult to assemble and operate.

SUMMARY OF THE INVENTION

Accordingly, it is an object of the invention to provide an improved system for dispensing cleaning liquid to a surface or carpet to be cleaned and for subsequently suctioning the liquid along with dirt and the like from the surface.

In particular, it is an object of the invention to provide such a system which is relatively uncomplicated, relatively inexpensive to fabricate and transport and relatively easy to assemble and operate.

The invention is directed to a liquid dispensing and suctioning attachment for dispensing liquid to a surface or carpet to be cleaned and for suctioning the liquid along with dirt and the like from the surface. The attachment is connectable through a tube with a source of suction, like a suction motor at a collection tank. The suction tube is included in a hand held tubular wand.

There is a suction nozzle at the end of the tube at the wand. The suction nozzle has an inlet positionable adjacent the surface to be cleaned for intake of the liquid, dirt, and the like, and has an outlet fitting attached to an intake end of the wand. The attachment further includes a tank for containing the liquid to be dispensed. The tank is physically located at and is attached to the nozzle at the end of the wand.

The attachment further includes a dispenser for selectively dispensing the liquid to the surface to be cleaned. The dispenser includes an actuator, means for biasing the actuator toward a closed position to retain the liquid in the tank and an extension extending from the actuator to a position remote from the actuator for being operated to move the actuator to an open position to dispense the liquid to the surface to be cleaned. The extension is slidably arranged between the tank and the tubular wand.

Other objects and features of the present invention will become apparent from the following description of a preferred embodiment of the invention considered in conjunction with the accompanying drawings.

BRIEF DESCRIPTION OF THE DRAWINGS

FIG. 1 is a side view of the tank, nozzle, dispensing system and lower wand section of a preferred embodiment of the liquid dispensing and suctioning system;

FIG. 2 is a side view of the upper control lever and wand sections of the preferred embodiment;

DESCRIPTION OF THE PREFERRED EMBODIMENT

Figure 3:
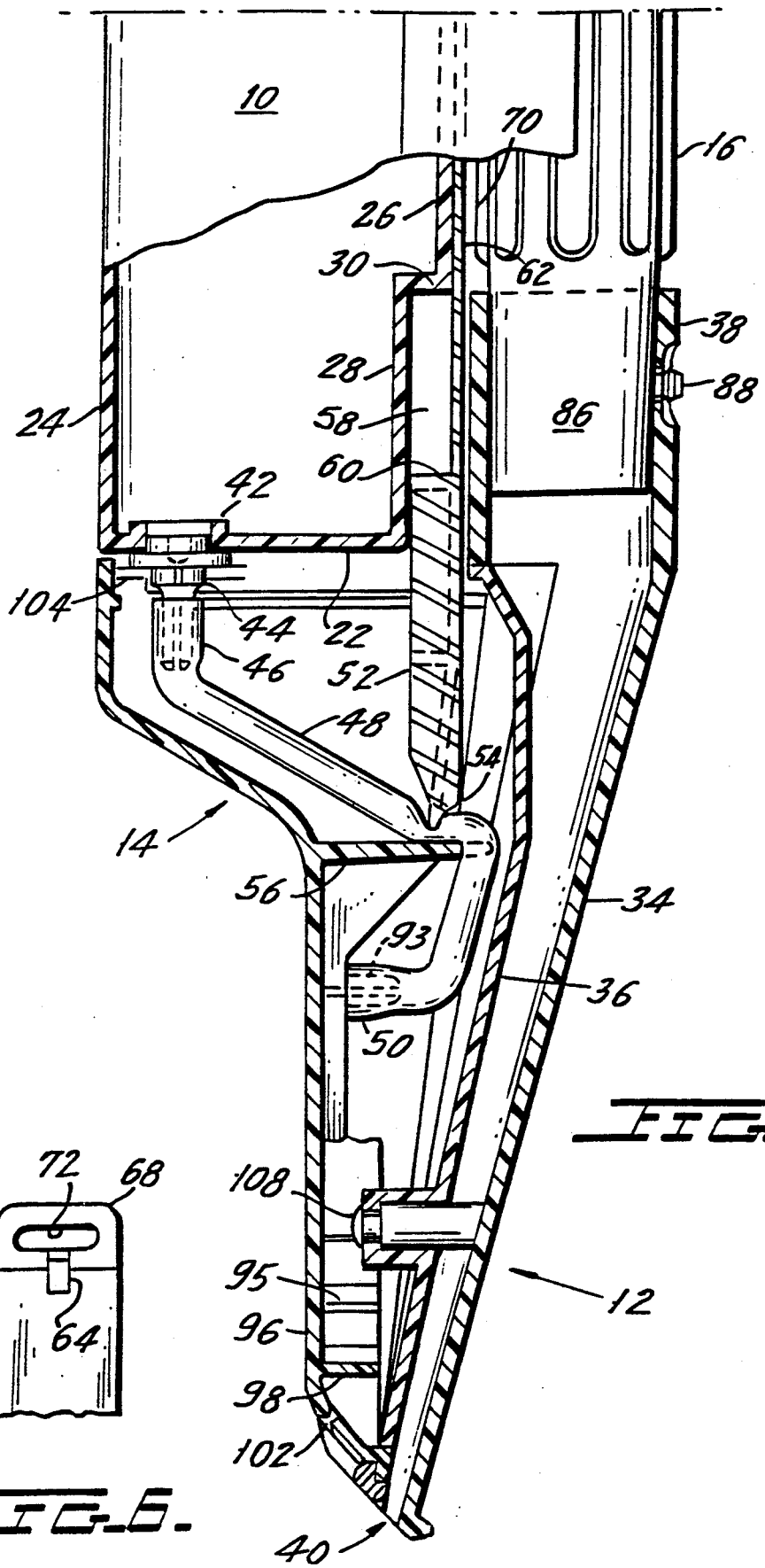
FIG. 3 is a cutaway view which details the lower portion of the features illustrated in FIG. 1.
Figure 6:
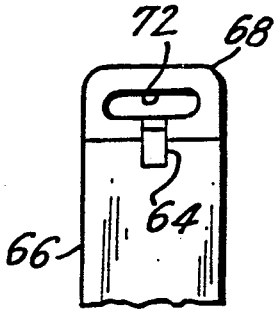
FIG. 6 is a rear view of the remote portion of the extension of the preferred embodiment.
Figure 4:
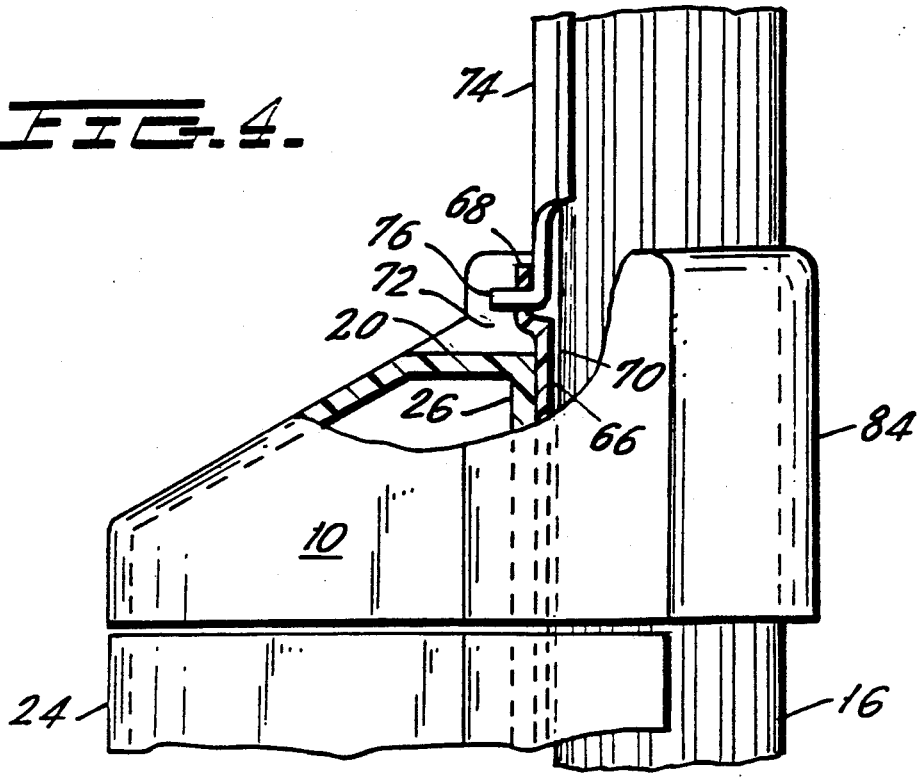
FIG. 4 is a cutaway view which details a connection used in the preferred embodiment.
Figure 5:
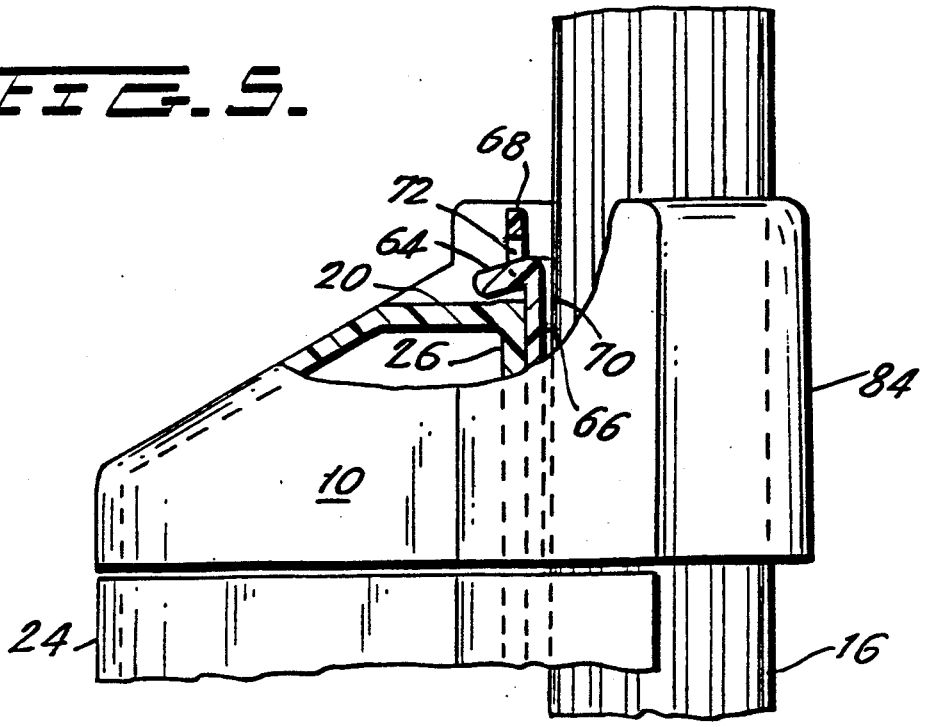
FIG. 5 is a cutaway view which details the stop member of the preferred embodiment.

The preferred embodiment of the invention includes a tank 10 for containing cleaning liquid (not illustrated) therein, a nozzle 12 for delivering the liquid and a dispensing system 14 for valving the liquid from the tank to the nozzle. The tank 10, the nozzle 12 and the dispensing system 14 are connectable to a lower tubular wand section 16 which in turn is connectable to an upper, separate tubular wand section 18. In operation, liquid is selectively and controllably dispensed from the tank 10 to a surface to be cleaned (not illustrated) to dissolve or lift off dirt and the like from the surface. Suction is then drawn from a below described suction source 110, through the wand sections 16 and 18, and then through the nozzle 12 so that the liquid, along with the dirt and the like, is drawn up through the nozzle 12 and out through the wand sections 16 and 18.

Except as otherwise indicated, the various parts of the preferred embodiment of the system are formed of molded, relatively rigid plastic.

The tank 10 is a total enclosure defined by an upper wall 20 away from the nozzle 12, an opposite lower wall 22 at the bottom of the tank, a back wall 24 which is at the side toward the user and a front wall 26, which has the nozzle 12 and wand section 16 in front of it. The walls 20–26 enclose the tank. A recess 28 is defined in the tank front wall 26 toward the lower wall 22 for receiving and guiding vertical shifting of the below described pinch slide 52. A ledge 30 defines the top of that recess. A filler cap 32 is accessibly placed near the top of the tank, through which the tank may be filled with liquid.

The suction nozzle 12 is preferably molded of clear plastic, permitting observation of the liquid being sucked through the nozzle. The nozzle has a front cover 34 facing the front of the attachment and a back wall 36 at the front of the waterfall 96. An outlet fitting 38 at the top of the nozzle connects it to the wand section 16. A suction inlet 40 at the bottom of the nozzle is to be placed at the surface to be suctioned. The cross-section of the nozzle 12 generally narrows in lateral side to side width and increases in front to back height from the intake inlet 40 to the outlet fitting 38.

The liquid dispensing system 14 includes an outlet fitting 42 located at the lower wall 22 of the tank 10. A connecting member 44 is spin-welded to the outlet fitting 42. The inlet end 46 of a flexible, resilient, preferably elastomeric rubber or plastic tube 48 is pushed over and retained on the connecting member 44. The opposite outlet end 50 of the tube 48 is held below the inlet end 46 and is maintained open so that cleaning liquid can flow under the force of gravity from the tank 10 through the connecting member 44, through the flexible tube 48 and then out past the open outlet end 50.

The dispensing system 14 further includes a tube pinch slide 52 which serves as an on-off valve for flow through the tube 48. The slide 52 includes a pinch tip 54 which is movable toward and away from a shelf 56 that is molded in the dispenser wall 96 and the shelf projects beneath the pinch tip 54. The flexible tube 48 passes between the tip 54 and the shelf 56. The slide 52 is biased down toward the shelf 56 by a compression spring 58. The compression spring 58 and a portion of the slide 52 are located within the recess 28 and between the tank 10 and the nozzle 12. The spring 58 is compressed between the ledge 30 of the tank 10 and the rear end 60 of the slide 52. Thus, the slide 52 is biased toward the shelf 56 so as to pinch the flexible tube 48 between the tip 54 and the shelf 56. When the flexible tube 48 is pinched, cleaning liquid cannot flow through the tube and is retained within the tank 10.

A lower extension 62 extends up from the slide 52. The extension 62 is used for pulling the slide 52 away from the shelf 56 to open the tube 48 which permits dispensing of the liquid. The extension 62 is relatively thin front to back and wide laterally so as to slide in front of the tank 10 and to the rear of the nozzle 12. The extension 62 has an arcuate cross-section to wrap around the surface of the lower wand section 16. A stop member 64 is provided at the remote upper end 66 of the extension 62. At the end 66, the cross-section of the extension 62 changes to a flat tongue 68 having a slot 72 that is open at one lateral side formed in it, which forms the stop member 64.

An upper control lever 74 engages and draws up on the extension 62. The lever 74 has an L-shaped hook 76 at its lower end which is fitted into the slot 72 to join the extension 62 and lever 74. A sleeve 78 is provided at the upper end 80 of the upper control lever 74. A circular opening 82 in the sleeve 78 slidably surrounds and in turn is supported by the upper tubular wand section 18. Thus, the long stretch of extension 62 and of lever 74 from the slide 52 to the sleeve 78 is supported between the tank and the nozzle by the sleeve 78. When the upper control lever 74 is pulled upwardly by manually pulling the sleeve 78 of the upper control lever 74 upwardly, the hook 76 pulls up the extension 62 which in turn raises the slide 52 away from the nozzle 12 to open the flexible tube 48. When the sleeve 78 is released, the compression spring 58 urges the slide 52 toward the shelf 56 to pinch closed the flexible tube 48.

The preferred embodiment is conveniently transported with the upper control lever 74 and the wand sections 16 and 18 disassembled. The preferred embodiment is easily assembled by first sliding the lower wand section 16 through a circular wand retaining fitting 84 which is integrally formed with the tank 10. The lower end 86 of the lower wand section 16 is retained in the outlet fitting 38 of the nozzle 12 by means of a spring biased button detent 88. Since the lower wand section 16 fits directly into the nozzle 12, the preferred embodiment is relatively easy to mold, operate and assemble. The hook of the upper control lever 74 is slid laterally into the open sided slot 72 while the upper lever 74 projects laterally out from the lower wand. The upper wand is slid into the sleeve 78. Then the upper control lever 74 with its hook 76 is rotated into alignment with the lower wand. This rotation locks the L-shaped hook 76 into the slot 72. The upper wand section 18 is then slid down into a fitting 90 of the lower wand section 16. The connection between the upper wand section 18 and the lower wand section 16 includes a spring-biased button detent 92. The wand sections 16 and 18 and the upper control lever 74 may be disassembled in the reverse sequence for compact storage.

Figure 8:
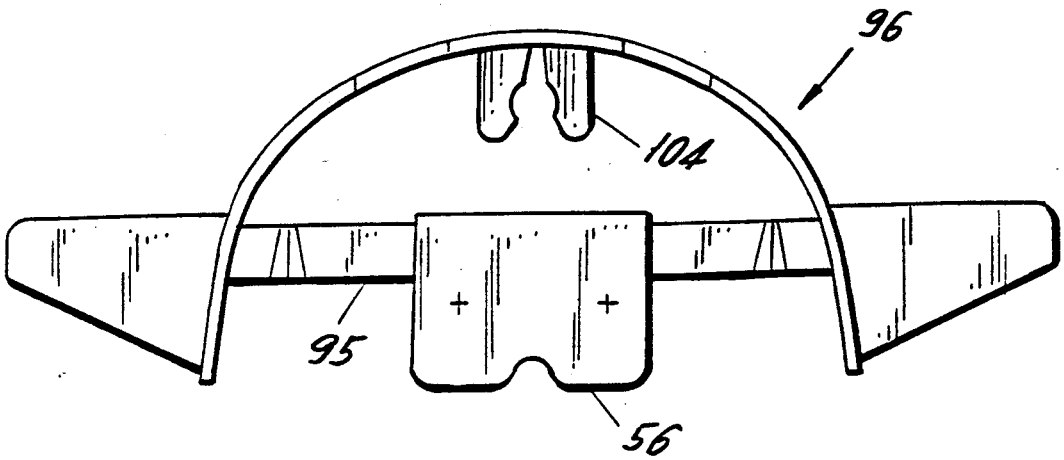
FIG. 8 is a top view of the waterfall of FIG. 7.
Figure 7:
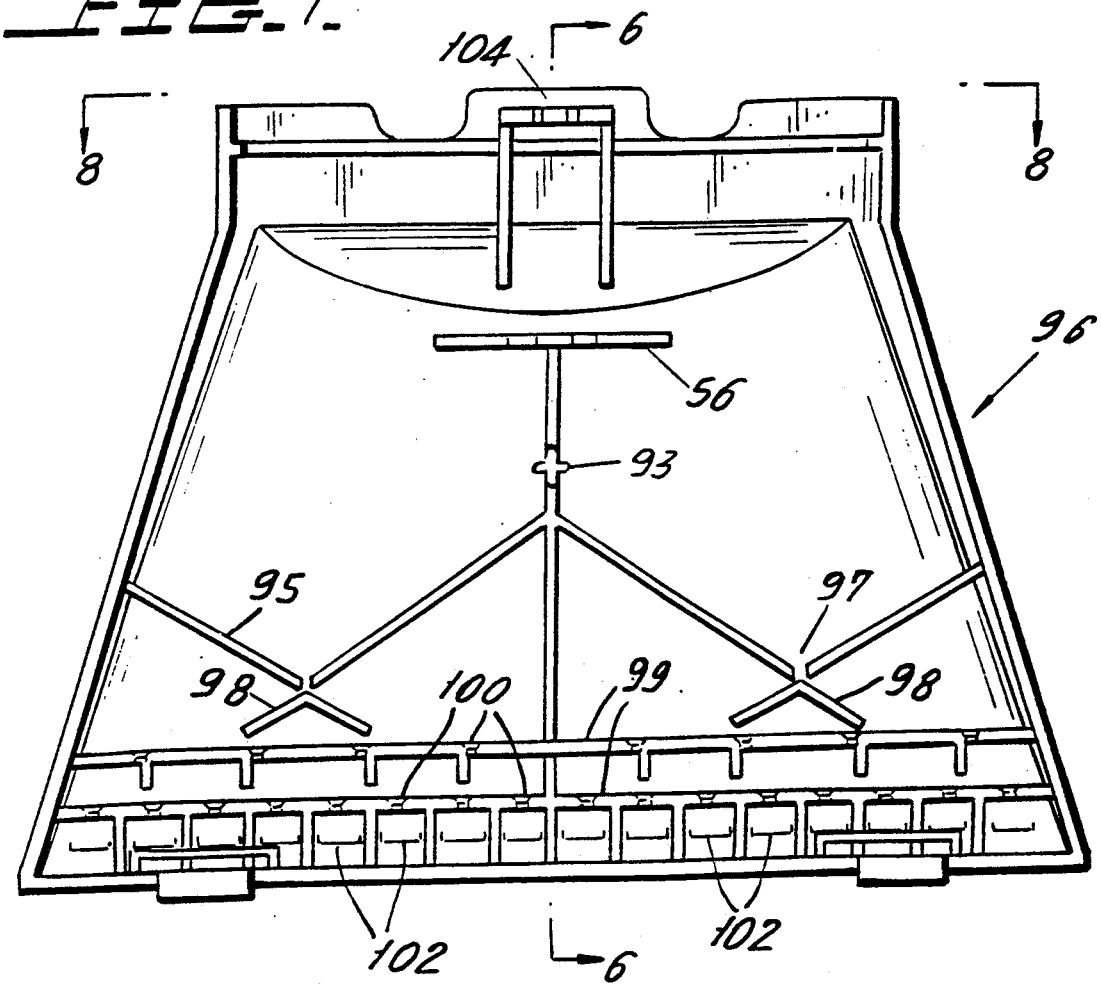
FIG. 7 is a front view of the cascade waterfall of the preferred embodiment.

The lower outlet end 50 of the flexible tube 48 is received on a prong 93 projecting from the front side of a cross-shaped initial flow divider 94. The divider 94 initially dispenses the liquid flow as it exits the tube 48. After the liquid falls off the divider, it cascades and flows across a waterfall arrangement 96 shown in FIGS. 7 and 8. That arrangement is located to the rear of the nozzle, and the rear wall of the waterfall arrangement is typically inclined downward and forward, so that the liquid runs down the back wall.

The waterfall arrangement 96 includes a first plurality of inclined shelves 95 which move the initially divided liquid laterally outward, through the openings 97, over the inclined further dividing shelves 98, onto the surface 99 and through the openings 100 over and through which the cleaning liquid cascades downwardly toward outlets 102 in a progressively wider pattern. Thus, the waterfall arrangement 96 serves to evenly spread the cleaning liquid across the full width of the waterfall arrangement which extends over the full width of the suction inlet 40 of the nozzle 12.

Figure 9:
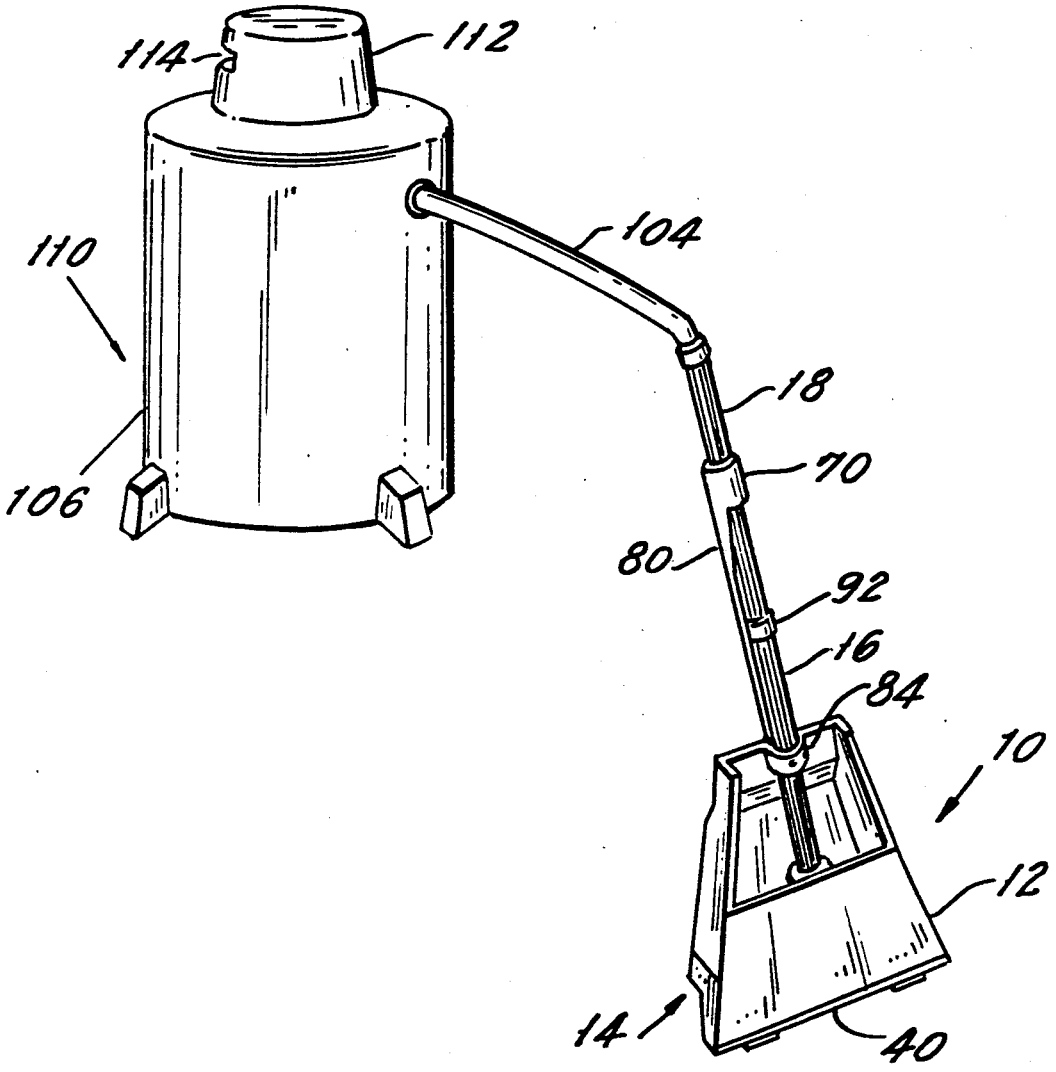
FIG. 9 shows one environment of use for the system of the invention.

After the cleaning liquid is dispensed through the openings 102 and onto the surface to be cleaned, the liquid and collected dirt is then sucked through the suction inlet 40 from the surface to be cleaned. As shown in FIG. 9, the upper wand section 18, which is hand held, is connected through a flexible hose 104 into the tank 106 of a conventional wet/dry pickup tank type electric vacuum or suction cleaner 110. A vacuum is drawn in the hose and wand section and suction nozzle 12 by a conventional blow motor 112 seated atop the tank which sucks air and liquid through the hose. The collected liquid falls into the tank 106 while the air is exhausted out of the outlet 114.

The preferred embodiment can be disassembled for cleaning or storage. The upper wand section 18 is first removed. This frees the upper control lever 74 for pivoting outward and for removal. The lower wand section 16 is removed from the nozzle. Then a snap-fit connection between the connecting member 44 and a retaining plate 104 is detached. Then the waterfall arrangement 96 is removed by rotating it away from the nozzle 12 until a hook-type connection 106 is disconnected. The tube 48 is removed from the connecting member 44 and the connector 94. The front cover 34 and the back wall 36 of the nozzle 12 are disassembled by removing a screw 108.

Although the invention has been described in connection with a preferred embodiment thereof, many variations and modifications may become apparent to those skilled in the art. It is preferred, therefore, that the invention be limited not by the specific disclosure herein, but only by the appended claims.

What is claimed is:

1. A liquid dispensing and suctioning system, comprising:

a tubular wand having a suction intake end and an exit end connectable for communicating with a remote suction source;

an attachment to said wand for dispensing liquid to a surface to be cleaned and for suctioning liquid from the surface, said attachment comprising:

a suction nozzle having an inlet positionable adjacent the surface to be cleaned for intake of liquid and having an outlet fitting attached to said intake end of said wand;

a tank supported at said suction nozzle for containing liquid to be dispensed; said tank being closed separate from said suction nozzle;

a dispenser for selectively dispensing liquid from said tank to the surface to be cleaned, said dispenser comprising a dispenser inlet communicating with said tank for receiving liquid therefrom, a dispenser outlet for delivery of liquid to the surface, and a dispenser conduit between said dispenser inlet and said dispenser outlet; said dispenser conduit having a flexible portion for being pinched to cut off liquid flow between said dispenser inlet and said dispenser outlet and said flexible portion being openable to permit flow;

an actuator movable against and away from said dispenser conduit; means for biasing said actuator toward a position to pinch said dispenser conduit for preventing liquid flow from said tank through said dispenser conduit; and a manually operable extension extending from said actuator up from said dispenser to a position toward said suction intake end of said wand for being graspable by a user for moving said actuator against the bias of said biasing means to an open position to open said flexible conduit to permit dispensing of liquid through said dispenser to the surface to be cleaned.

2. The system of claim 1, wherein said dispenser conduit includes a flexible tube, and said dispenser inlet comprises said tube having a first end attached to and in communication with said tank.

3. The system of claim 2, wherein said actuator includes a slide movable for pinching said tube and said biasing means normally urges said slide toward said pinching tube; and said extension is connected with said slide.

4. The system of claim 3, wherein said attachment includes a shelf beneath said slide for supporting said tube in position to be pinched by said slide against said shelf.

5. The system of claim 3, wherein said tank includes a recess shaped for accommodating and guiding movement of said slide and said extension projects out of said recess.

6. The system of claim 5, wherein said biasing means comprises a compression spring; a ledge in said recess supporting said compression spring, said spring being compressed within said recess and between said ledge and said slide.

7. The system of claim 2, wherein said dispenser conduit includes a second end disposed below said first end, so that liquid flows from said tank through said dispenser conduit under the force of gravity.

8. The system of claim 7, wherein said attachment includes a cross-shaped piece inserted within said second end of said dispenser conduit for maintaining said second end in an open condition and for dispersing the liquid flowing from said second end.

9. The system of claim 8, wherein said dispenser comprises a waterfall plate including a plurality of walls spaced away from and below said dispenser conduit second end for further dispersing the liquid flow, and said dispenser outlet comprises a plurality of outlet openings arrayed across said dispenser.

10. The system of claim 9, wherein said cross-shaped piece is on said waterfall plate.

11. The system of claim 1, wherein said dispenser comprises a waterfall plate including a plurality of walls spaced away from and below said dispenser conduit second end for dispersing the liquid flow, and said dispenser outlet comprises a plurality of outlet openings arrayed across said dispenser.

12. The system of claim 1, wherein said wand has an upper part and a lower part which are lockable together by locking means when substantially aligned; and further comprising:

an upper control lever assembled together with said wand upper part, said upper control lever having a lower end, said extension from said actuator having a second end which extends up and beyond said tank, said second end having a first connector;

said first connector and said lower end of said upper control lever being connected together so that said actuator can be controlled by operation of said upper control lever at said wand upper part;

wherein said lower end of said upper control lever includes a second connector for engaging said first connector, said first connector and second connector having engaging means for permitting said second connector to be installed in engagement with said first connector by angling said upper control lever to misalign with respect to said extension, and for locking said second connector and first connector together by subsequently angling said upper control lever to align with said extension, and substantially simultaneously aligning said upper and lower wand parts so as to lock them together by said locking means.

13. The system of claim 9, wherein said upper control lever includes a sleeve surrounding said upper end of said wand, said upper control lever being slidable with respect to and along said wand.

14. The system of claim 13, wherein said engaging means and said locking means permit said first and second connectors to be engaged, and permit said upper and lower wand parts to be locked, with said sleeve continuously surrounding said upper end of said wand.

15. The system of claim 1, wherein said extension is slidably arranged between said tank and said tubular wand.

16. The system of claim 1, wherein said dispenser outlet includes a cross-shaped piece inserted within said dispenser conduit for dispersing the liquid flowing through said dispenser conduit.

* * * * *

UNITED STATES PATENT AND TRADEMARK OFFICE
CERTIFICATE OF CORRECTION

PATENT NO. : 5,103,526

DATED : April 14, 1992

INVENTOR(S) : Robert C. Berfield

It is certified that error appears in the above-identified patent and that said Letters Patent is hereby corrected as shown below: item [56]

On the cover page, under the heading "References Cited" omit the present listing of U.S. Patent Documents appearing in columns 1 and 2 and substitute the following therefor:

U.S. PATENT DOCUMENTS

| | | | |
|---|---|---|---|
| Re. 25,539 | 12/1965 | Krammes | 15/320 |
| 1,454,381 | 5/1923 | Stepp | 15/320 |
| 1,554,875 | 9/1925 | Miles | 15/320 UX |
| 2,149,453 | 3/1939 | Longshore et al. | 15/320 |
| 2,568,803 | 9/1951 | Guenst | 15/321 |
| 2,822,061 | 2/1958 | Pettit et al. | 15/322 X |
| 2,986,764 | 6/1961 | Krammes | 15/320 |
| 3,020,576 | 2/1962 | Gerber | 15/320 |
| 3,079,576 | 2/1963 | Rockwell | 134/10 |
| 4,218,900 | 8/1980 | Caplan et al. | 15/322 X |
| 4,320,555 | 3/1982 | Watson | 15/321 |
| 4,329,756 | 5/1982 | Chicoine et al. | 15/322 X |
| 4,333,203 | 6/1982 | Yonkers | 15/322 |
| 4,335,486 | 6/1982 | Kochte | 15/322 |
| 4,485,518 | 12/1984 | Kasper | 15/322 |
| 4,534,083 | 8/1985 | Hampson | 15/321 |
| 4,559,665 | 12/1985 | Fitzwater | 15/339 |
| 4,845,802 | 7/1989 | Miller et al. | 15/322 X |
| 4,910,828 | 3/1990 | Blase et al. | 15/321 |

FOREIGN PATENT DOCUMENTS

| | | |
|---|---|---|
| 278632 | 2/1988 | European Patent Office |

UNITED STATES PATENT AND TRADEMARK OFFICE

CERTIFICATE OF CORRECTION

PATENT NO. : 5,103,526
DATED : April 14, 1992
INVENTOR(S) : Robert C. Berfield

It is certified that error appears in the above-indentified patent and that said Letters Patent is hereby corrected as shown below:

| | | |
|---|---|---|
| 2834644 | 2/1980 | West Germany |

Signed and Sealed this

Ninth Day of November, 1993

Bruce Lehman

*Attest:*

BRUCE LEHMAN

*Attesting Officer*

*Commissioner of Patents and Trademarks*